US006164999A

United States Patent [19]

McCutchan et al.

[11] Patent Number: 6,164,999

[45] Date of Patent: *Dec. 26, 2000

[54] ZERO INSERTION FORCE SOCKET AND METHOD FOR EMPLOYING SAME TO MOUNT A PROCESSOR

[75] Inventors: Dan R. McCutchan, Redwood City, Calif.; Glen Patrick Gordon, Federal Way; Leonard Ottis Turner, Vancouver, both of Wash.; Michael P. Brownell, Los Gatos, Calif.; Larry B. Wheeler, Olympia, Wash.

[73] Assignee: Intel Corporation, Santa Clara, Calif.

[ * ] Notice: This patent is subject to a terminal disclaimer.

[21] Appl. No.: 08/902,678

[22] Filed: Jul. 30, 1997

[51] Int. Cl.[7] ..... H01R 13/625

[52] U.S. Cl. ..... 439/342

[58] Field of Search ..... 439/342, 259, 439/263, 265, 268, 296

[56] References Cited

U.S. PATENT DOCUMENTS

| | | | |
|---|---|---|---|
| 4,204,722 | 5/1980 | Yasui et al. . | |
| 4,445,740 | 5/1984 | Wallace | 439/342 |
| 4,504,887 | 3/1985 | Bakermans et al. . | |
| 4,840,576 | 6/1989 | Nierescher et al. . | |
| 4,950,980 | 8/1990 | Pfaff | 439/296 |
| 5,006,962 | 4/1991 | Haley . | |
| 5,073,116 | 12/1991 | Beck, Jr. . | |
| 5,400,904 | 3/1995 | Maston, III et al. . | |
| 5,489,217 | 2/1996 | Scheitz et al. | 439/342 |
| 5,493,237 | 2/1996 | Volz et al. . | |
| 5,567,177 | 10/1996 | Foerstel et al. . | |
| 5,707,247 | 1/1998 | Konstad | 439/342 |
| 5,721,673 | 2/1998 | Klein | 439/342 |
| 5,855,489 | 1/1999 | Walker | 439/342 |
| 6,002,591 | 12/1999 | McCutchan et al. . | |

*Primary Examiner*—Neil Abrams
*Assistant Examiner*—Eugene G. Byrd
*Attorney, Agent, or Firm*—Blakely, Sokoloff, Taylor & Zafman LLP

[57] ABSTRACT

The invention in one embodiment is a zero insertion force socket including a base; a cover engaged with the base to reciprocate in first and second directions; and a lever pivotably mounted to the base to move the cover in the first direction when the lever is pivoted laterally from a first position to a second position. In another embodiment, the invention is a printed circuit board assembly including a printed circuit board; a zero insertion force socket surface mounted to the printed circuit board; and a processor coupled to the zero insertion force socket.

29 Claims, 6 Drawing Sheets

ZERO INSERTION FORCE SOCKET AND METHOD FOR EMPLOYING SAME TO MOUNT A PROCESSOR

BACKGROUND OF THE INVENTION

1. Field of the Invention

This invention pertains generally to a zero insertion force ("ZIF") socket and, more particularly, a ZIF socket adapted for use in high density circuits.

2. Background Information

Integrated circuits are typically encapsulated in a plastic shell through which electrical couplings are made with one or more pins. The integrated circuit, shell, and pins typically constitute a discrete electronic component referred to as an integrated circuit package. Frequently, integrated circuit packages are inserted into a socket mounted to a printed circuit ("PC") board. The pins of the integrated circuit package are inserted into corresponding holes of the socket, whereupon they contact the terminals of the socket. Electrical couplings can be made to the pins of the integrated circuit package in any number of ways known to the art.

Historically, integrated circuit packages were dropped directly into a socket and then secured by applying pressure to the top of the package to force the contact with the socket terminals. This type of socket came to be known as a "low insertion force" ("LIF") socket. This technique frequently yielded bent or broken pins when pins were misaligned with the socket's holes, and packages with bent or broken pins were typically discarded. Early integrated circuit packages were relatively inexpensive, and so economic losses from these errors were tolerable. However, as integrated circuits became larger, more powerful, and more expensive, such losses became less acceptable. Thus, alternative techniques were developed.

One technique developed in response to this concern was the zero insertion force ("ZIF") socket. A ZIF socket typically is an assembly of a top and a bottom with a cammed lever extending from one side. The top and bottom define a plurality of relatively large holes with which the pins are aligned as the package is inserted. However, instead of applying pressure to the top of the package to contact the pins with the terminals, the cammed lever is flipped to move the top laterally relative to the bottom to create the electrical coupling.

ZIF sockets are generally used to couple processors to circuits fabricated on printed circuit boards. Processors such as microprocessors and digital signal processors are expensive and have relatively large numbers of pins. Thus, the advantages of using ZIF sockets rather than LIF sockets are particularly important as to processors.

One significant drawback to using traditional ZIF socket designs is the large amount of space they occupy. ZIF sockets are typically mounted to PC boards by inserting mounting pins through holes in the board whereupon couplings are soldered to the opposite side of the board. Thus, a single integrated circuit package requires both sides of the board. Through-board mounting techniques consequently also lengthen bus lines, thereby restricting processor operating speeds. These ZIF socket designs also employ a certain amount of space for operating the lever that must be thrown to establish and break the electrical coupling. Thus, ZIF sockets generally do not allow close placement of boards within a computer. Applications employing electronic components in high density, such as "laptop" or "notebook" computers, consequently use LIF sockets rather than ZIF sockets.

However, traditional ZIF socket designs are becoming problematical for some applications as the demands on personal computing resources rise. More particularly, new personal computers, even desktop versions, require ever higher densities of electrical components operating at still higher speeds. Traditional ZIF socket designs are deficient not only in that they require relatively large amounts of space, but also in that they decrease operating speeds. Thus, there is a need for a new ZIF socket design to address these and other drawbacks.

The present invention is directed to overcoming, or at least reducing the effects of, one or more of the problems set forth above.

SUMMARY OF THE INVENTION

In one embodiment, a zero insertion force socket includes a base; a cover engaged with the base so that at least on of the cover and the base reciprocates relative to the other one of the cover and the base in first and second directions; and a lever pivotably mounted to the base to move the cover in the first direction when the lever is pivoted laterally from a first position to a second position. In another embodiment, a printed circuit board assembly includes a printed circuit board; a zero insertion force socket surface mounted to the printed circuit board; and a processor coupled to the zero insertion force socket. In still another embodiment, a method for mounting a processor to a printed circuit board comprises surface mounting a zero insertion force socket to the printed circuit board, the socket having a plurality of pin holes therein and a lever; inserting a plurality of contact pins from the processor into the pins holes of the socket; and throwing the lever of the zero insertion force socket to establish the electrical coupling.

BRIEF DESCRIPTION OF THE DRAWINGS

A more particular description of the invention briefly summarized above is set forth below by way of particular embodiments disclosed in the drawings of this specification and as described in connection therewith. The drawings nevertheless illustrate only typical, particular embodiments of the invention and are not to be considered limiting thereon as the invention may admit to other equally effective embodiments. In the drawings.

DETAILED DESCRIPTION OF SPECIFIC EMBODIMENTS

Numerous specific details are set forth below in the detailed description of particular embodiments to provide a thorough understanding of the present invention. However, one of ordinary skill in the art having the benefit of this disclosure will understand that the present invention may be practiced without many of the details presented since such details will be useful depending on the particular embodiment being employed. Conversely, in other instances, well known details have not been described for the sake of clarity so as not to obscure the invention. It will be appreciated that supplying such details would be a routine undertaking for those of ordinary skill in the art, even if a complex and time-consuming task, given the benefit of this disclosure.

Figure 1:
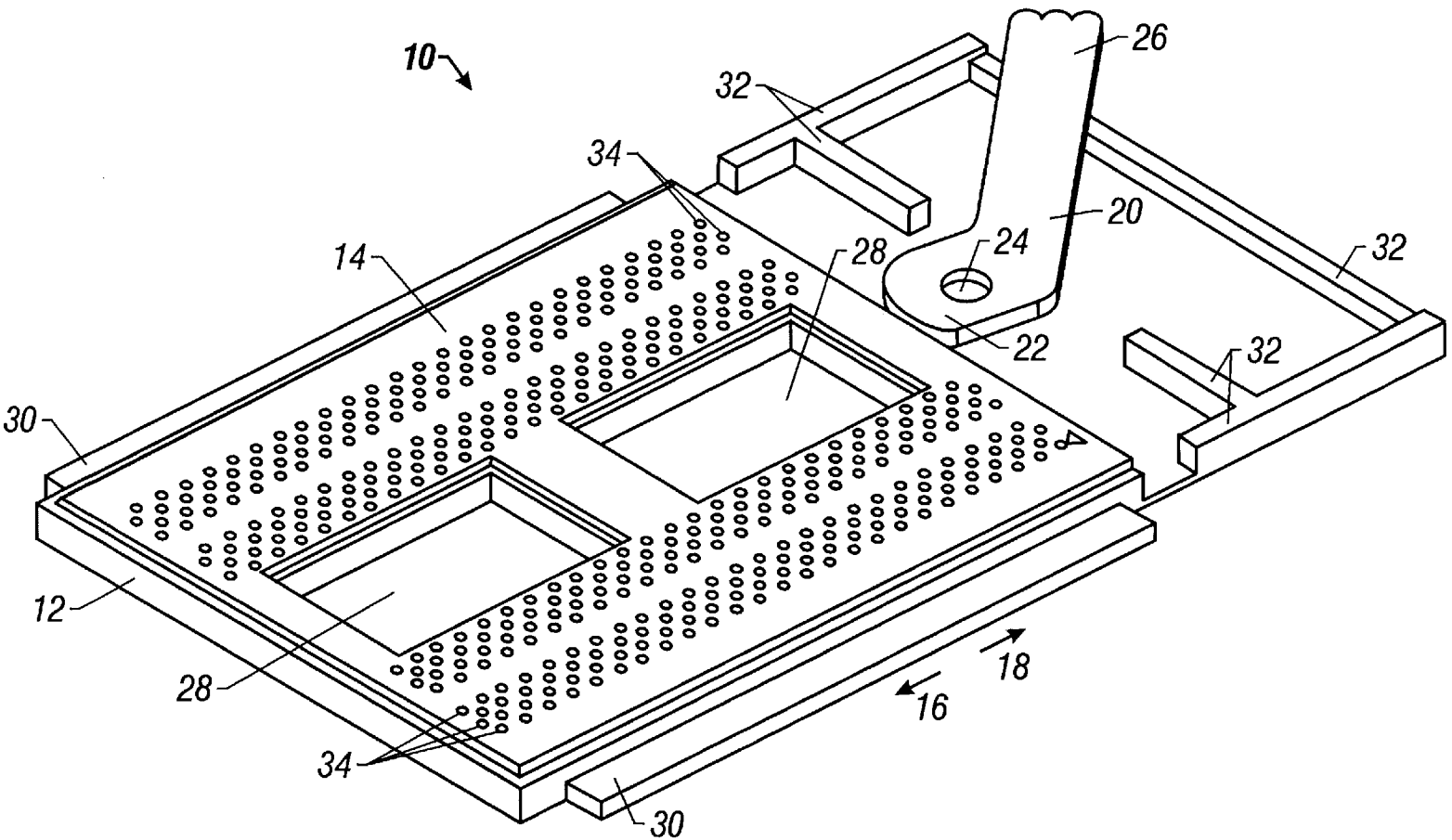
FIG. 1 is an isometric view of one embodiment of a zero insertion force socket constructed in accord with the present invention.

FIG. 1 illustrates one particular embodiment of a zero insertion force socket 10 constructed in accord with the present invention. The zero insertion force socket 10 comprises a base 12, a cover 14 engaged with the base 12 to reciprocate in first and second directions indicated by the arrows 16 and 18, respectively, and a lever 20. Note, however, that some embodiments may engage the base 12 to the cover 14 in such a manner that the cover reciprocates in first and second directions. Thus, the cover 14 is engaged with the base 12 so that one of the cover 14 and the base 12 reciprocates relative to the other one of the cover 14 and the base 12 in first and second directions The lever 20 is pivotably mounted to the base 12 to move the cover 14 in the first direction 16 when the lever 20 is pivoted laterally from a first position not shown in, but apparent from, FIG. 1 to a second position shown in FIG. 1. The lever 20 may, however, be pivotably mounted to the cover 14 to move to base 12 in like manner in alternative embodiments. The lever 20 in the embodiment illustrated in FIG. 1 includes a cam 22 by which the lever 20 is pivotably mounted to the base 12 and a shaft 26 integrally formed with the cam 22 for rotating the cam 22 about a pivot 24. The cam 22 contacts the cover 14 and the shaft 26 extends laterally from the base 12 as shown. The base 12 and the cover 14 each have two bores 28 therethrough to reduce weight and material costs, but the bores 28 are not necessary to the practice of the invention. The base 12 in the particular embodiment illustrated furthermore includes two spacer flanges 30 extending therefrom and several ribs 32. The ribs 32 improve structural strength but also are not necessary to the practice of the invention.

As will be recognized by those in the art., the cover 14 is biased in the direction 18 and reciprocates in a first direction 16 and a second direction 18 as the cam 22 of the lever 20 is rotated about the pivot 24. The cover 14 is engaged with the base 12 in a manner known to the art, such that, when the lever 20 is in the second position shown in FIG. 1, the cover 14 is aligned with the base 12 and, when the lever 20 is moved laterally to the first position (not shown), the cover 14 is offset from the base 12. The base 12 and the cover 14 have a plurality of socket holes 34 into which the pins (not shown) of a processor (also not shown) can be inserted when the lever 20 is in the first position such that the cover 14 is offset from the base 12. The lever 20 can then be thrown to the second position shown in FIG. 1 to reciprocate the cover 14 in the first direction 16 and thereby align the cover 14 with the base 12. When the pins of the processor are inserted and the cover 14 is aligned with the base 12, the electrical contact for the contact pins is secured.

Note also that the lever 20 extends laterally from the base 12 and is moved from one position to another laterally relative to the base 12. By moving the lever 20 laterally rather than vertically as found in the prior art, the socket 10 has a low profile, which permits closer spacing among processors and printed circuit board assemblies as discussed below. The lever 20 in the embodiment of FIG. 1 extends from one end of the base 12, but this is not necessary to the practice of the invention so long as the lever 20 moves from one position to the other laterally.

Figure 2A:
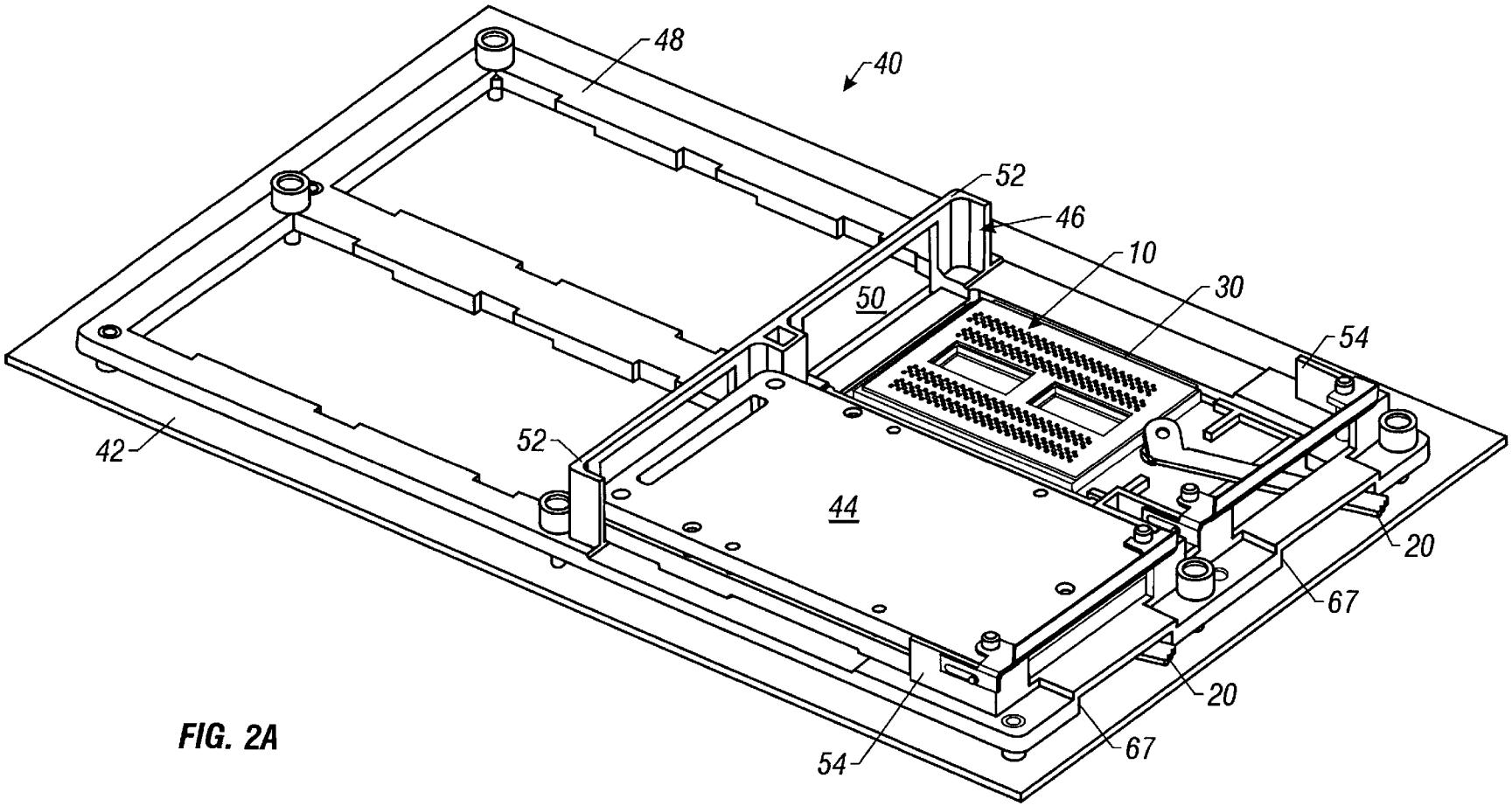
FIGS. 2A and 2B illustrate in assembled and partially exploded, isometric views, respectively, a technique for surface mounting the socket of FIG. 1 in one particular embodiment of the invention.
Figure 2B:
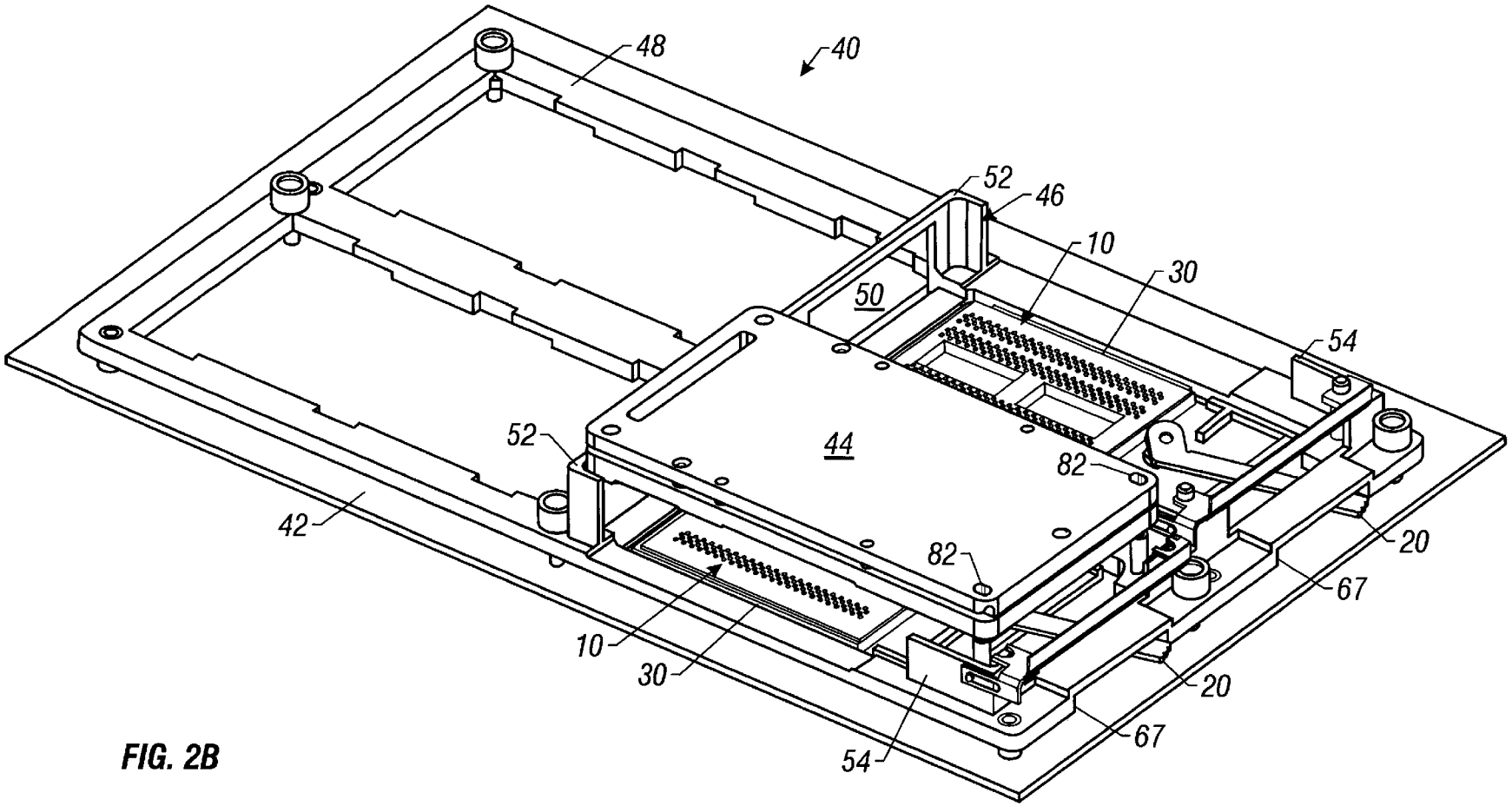

FIGS. 2A and 2B illustrate a technique for surface mounting the socket 10 in one particular embodiment of the invention. FIGS. 2A and 2B depict a subassembly 40 of a printed circuit ("PC") board assembly 80 illustrated in FIG. 4. The subassembly 40 generally comprises a printed circuit board 42, a processor 44, and a socket 10. The mounting bracket 46 vertically and laterally restrains the processor 44 when assembly is complete as discussed further below. The terms "vertically" and "laterally" as used herein shall be defined relative to the base 48, shown in FIG. 2A, of the bracket 46 regardless of the orientation with respect to gravity.

Figure 3A:
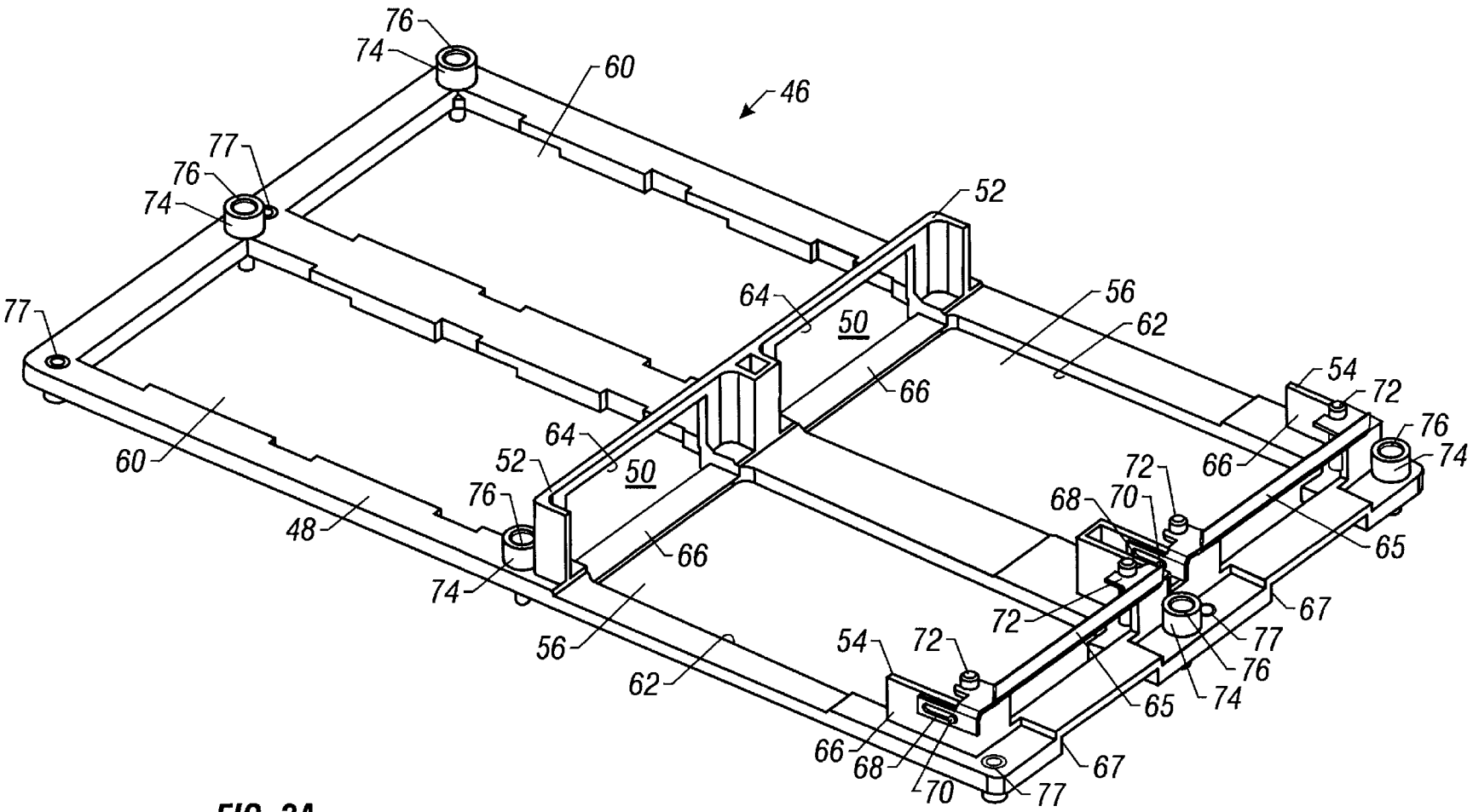
FIGS. 3A and 3B are assembled and partially exploded, isometric views, respectively, of a mounting bracket employed in the embodiment of FIGS. 2A and 2B.
Figure 3B:
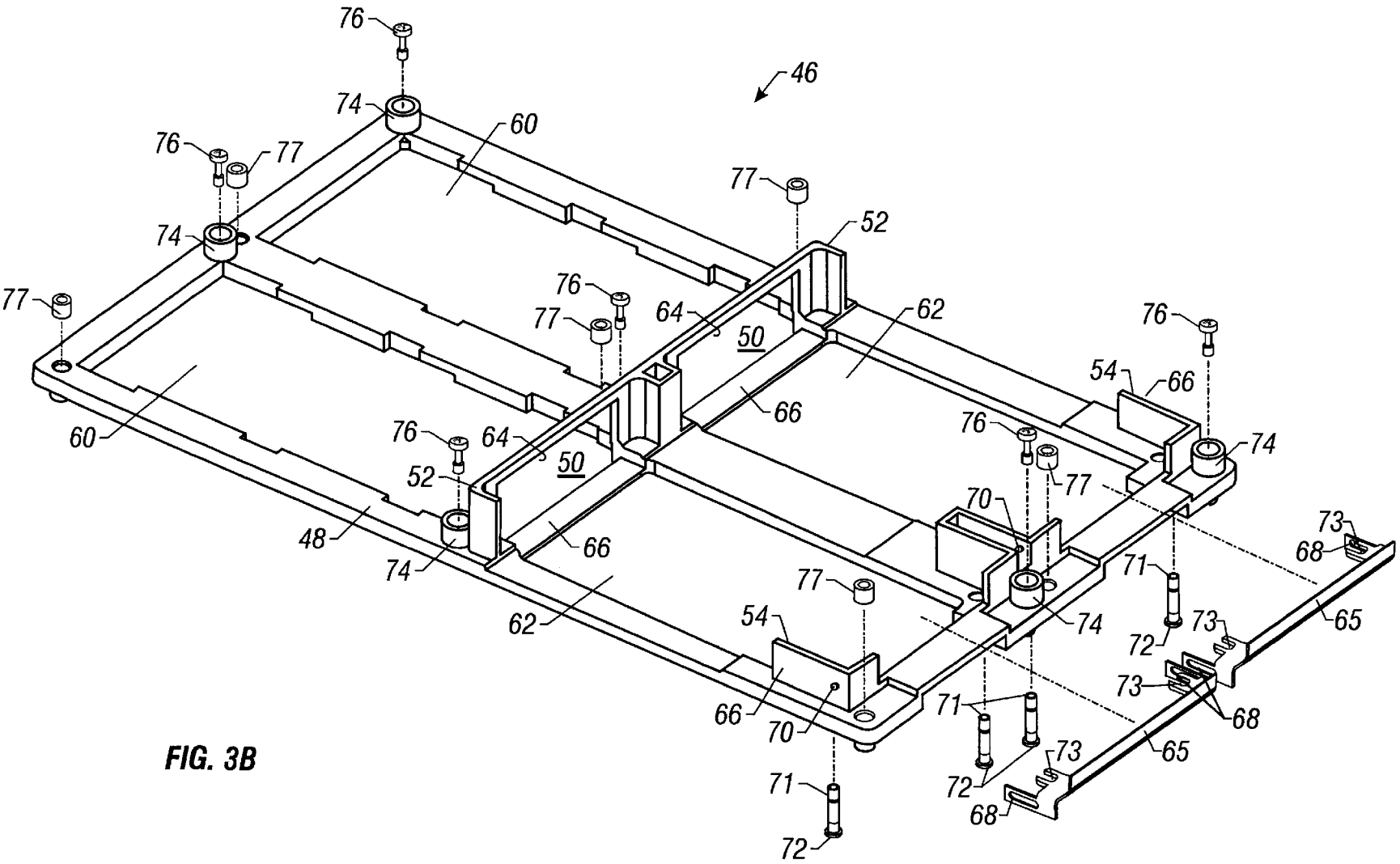

FIGS. 3A and 3B detail the mounting bracket 46. This particular embodiment of the invention comprises a base 48 having an opening 50 and two containment members 54 and 52 rigidly extending from the base 48. The two containment members 54 and 52 define a void 56 shaped to accommodate an integrated circuit device as best illustrated for this embodiment in FIGS. 2A and 2B and as discussed below. The phrase "shaped to accommodate" as used herein shall mean shaped so as to effect the applicable structural relationship as described more fully below to vertically and laterally constrain the processor 44.

Returning to FIGS. 3A and 3B, although the bracket 46 in the particular embodiment illustrated includes two containment members 54 and 52, it is envisioned that alternative embodiments could be constructed in which the two containment members 54 and 52 are structurally joined to effect a single containment member. Also, the base 48 and the containment member 52 in the particular embodiment shown are integrally formed and are constructed from a hardened, molded plastic although the invention is not so limited. In the particular embodiment illustrated, the plastic is a polycarbonate having about 30% glass fill. The base 48 and the containment member 52 might, in alternative embodiments, comprise separate structures joined or affixed to one another by any suitable technique known to the art. Further, in the embodiment of FIGS. 3A and 3B, the containment member 54 generally comprises a stainless steel spring clip 65 engaged with the two flanges 66 by the interaction of the slots 68 and the buttons 70. The spring clip 65, during assembly, is free to slide laterally, guided by the buttons 70 engaged in the slots 68. The engagement of the spring clip 65 is secured by the snap fit between the recessed ring 71 of the stainless steel retaining pins 72 and the notches 73 of the spring clip 65 as shown. Alternative embodiments may also be constructed from other materials.

Figure 4:
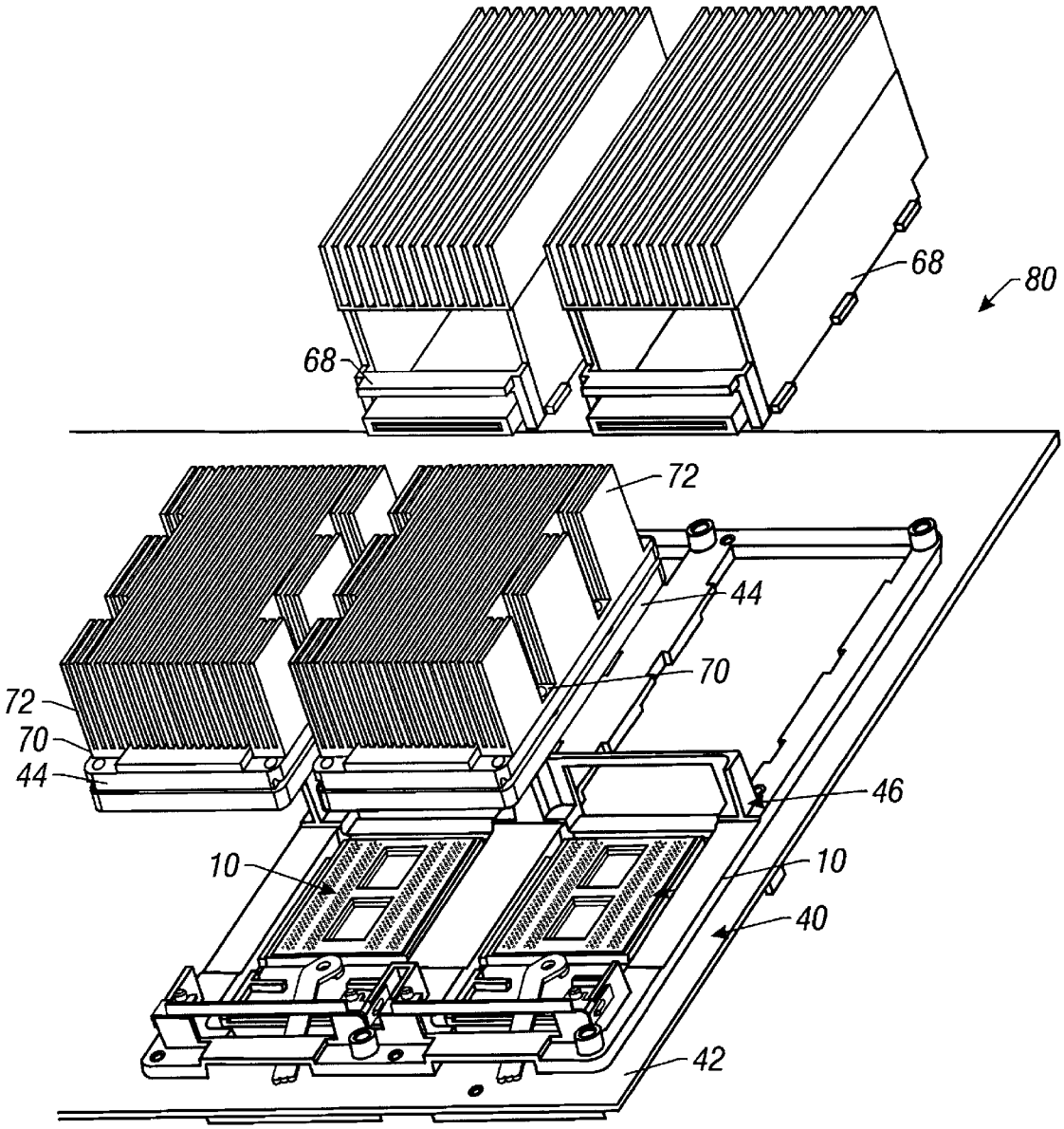
FIG. 4 is a partially assembled, partially exploded, isometric view of a printed circuit assembly including the socket of FIG. 1 and the bracket of FIGS. 3A and 3B.

The base 48 has two openings 50, each shaped to accommodate a socket 10. Although the embodiment illustrated has two openings 50, some alternative embodiments may have more or fewer openings 50. Each opening 50 of the particular embodiment illustrated is also shaped to accommodate a power pod as discussed below although this is not necessary to the practice of the invention. More particularly, as shown in FIG. 3A, the one end 60 of the opening 50 is shaped to accommodate a power pod whereas the other end 62 of the opening 50 is shaped to accommodate a socket 10. The containment member 52 also has a notch 64 through which a power pod may be electrically coupled to an integrated circuit device when the bracket 46, a socket 10, a processor 44, and a power pod are assembled as is discussed below in coupling with FIG. 4. Note that the embodiment illustrated includes a rib 66 to increase structural strength although this is not necessary to the practice of the invention. Thus, the notch 64 may be contiguous with the opening 50 in some embodiments. Further, in embodiments in which the opening 50 is not shaped to accommodate a power pod, notch 64 may be omitted altogether. Note that the bracket 46 further includes the slots 67 through which, as shown in FIGS. 2A, 2B, and 4, the lever 20 extends when the bracket 46 and the socket 10 are assembled.

The PC board subassembly 40 of FIGS. 2A and 2B is constructed by first inserting the retention pins 72, shown in FIGS. 3A and 3B, through the mounting bracket 46 and affixing the mounting bracket 46 to the printed circuit board 40 as discussed below. The sockets 10 are positioned on board 42 relative to bracket 46 by two pins (not shown) extending upward from the substantially planar surface of board 42. The pins are to align with and engage blind bores on the bottom of the sockets 10. The sockets 10 are affixed to board 42 by a plurality of solder bumps (not shown) on the bottom thereof. Note how the spacer flanges 30 position the sockets 10 in the opening 50. Note also that the surface mounting technique can be practiced with traditionally designed ZIF sockets coupling processors to PC boards. Thus, this aspect of the invention is not necessarily limited to the ZIF socket 10 of FIG. 1.

Assembly continues by aligning the bores 82, shown in FIG. 2B, in the packaging of the processors 44 with the corresponding retention pins 72 and the contact pins (not shown) protruding from the bottom of the processor 44 with the corresponding holes in the socket 10. The processor 44 is then inserted into the socket 10 as discussed above in coupling with FIG. 1. As the processors 44 are positioned between the containment members 52 and 54, the retaining pins 72 pass through the bores 82 through the processors 44 extending above the upper surface thereof and exposing the recessed rings 71. The spring clips 65 are then translated laterally inwardly and over the upper surface of the processors 44 until the notches 73 engage the recessed rings 71 to capture the processors 44 therein. The spring clip 65 is then engaged with the flanges 66 and the retention pins 72 as described above. As shown in FIG. 2A, the spring clips 65 include a lip 75 that, when the spring clip 65 is engaged with the flanges 66 and the retention pins 72, vertically restrains the processor 44.

When the various components are assembled, the edges 78 of the openings 50 at least partially circumscribe the sockets 10 as best shown in FIGS. 2A and 2B. Note that this structural relationship does not require actual physical engagement or even contact between the edges 78 and the sockets 10 although such contact is desirable in some embodiments. Some embodiments may employ only close juxtaposition. The acceptable separation between the edges 78 and the sockets 10 will vary, as will be recognized by those in the art having the benefit of this disclosure, depending on a number of factors. Two factors include the amount of shock and the amount of vibration the subassembly is designed to withstand. Thus, the openings 50 are "shaped to accommodate" the sockets 10 in that they affect the structural relationship in which the edges 78 thereof at least partially circumscribe the sockets 10. Although not shown, the edges 78 of the openings 50 of the particular embodiments illustrated also at least partially circumscribe the power pods 68 in the manner described above for the sockets 10.

Referring to FIG. 2B, the containment members 54 and 52 rigidly extending from the base 48 of the bracket 46 laterally constrain the processor 44. This structural relationship also does not require actual physical engagement or even contact between the containment members 52 and 54 and the processors 44 although such contact is desirable in some embodiments. Alternative embodiments may require only close juxtaposition. The acceptable separation, if any, between the containment members 52 and 54 and the processors 44 will vary, as will be recognized by those in the art having the benefit of this disclosure, depending on a number of factors. Two factors include the amount of shock and the amount of vibration the subassembly is designed to withstand.

Returning again to FIGS. 3A and 3B, the mounting bracket 46 includes at least one die 74 through which the fasteners 76 shown in FIG. 3B affix the bracket 46 to the printed circuit board 42. The embodiment of bracket 46 illustrated in FIGS. 3A and 3B is intended to be mounted to the printed circuit board 42 (shown in FIGS. 2A and 2B) directly opposite another such bracket 46 (not shown). Thus, the nuts 77 shown in FIGS. 3A and 3B are threaded onto the fasteners 76 of the bracket 46 that would be mounted to the obverse side of the printed circuit board 42 as shown best in FIGS. 2A and 2B. Similarly, the fasteners 76 shown in FIGS. 3A and 3B are to be threaded onto the fasteners 76 affixing a bracket 46 to the obverse side of the printed circuit board 42, again as best shown in FIGS. 2A and 2B. The number of dies 74, fasteners 76, and nuts 77 is not material provided the bracket 46 is securely mounted to the printed circuit board 42. One particular embodiment employs six of the dies 74, the fasteners 76, and the nuts 77. The fasteners 38 in the embodiment illustrated are stainless steel captive screws and the nuts 77 are constructed from brass, but other materials may be used. Other techniques may be employed to affix the mounting bracket 46 to the printed circuit board 42. For instance, an adhesive as may be known in the art may be applied to the surface contact between the bracket 46 and board 42 respectively. Still other embodiments may use other techniques.

Note that each embodiment illustrated mounts two sockets 10 and two processors 44. As noted above, the bracket 46 may be used to mount a single processor 44 and, in some embodiments, as many as four processors 44 if two brackets 46 are mounted on opposite sides of the PC board 42. Because the socket 10 is surface mounted, embodiments of subassembly 40 and assembly 80 employing as many as four sockets 10 and four processors 44 are possible. The number of processors is not material to the practice of the invention.

FIG. 4 is a partially exploded, partially assembled, isometric view of one embodiment of the present invention wherein the mounting socket 10 of FIG. 1 is assembled with other components to produce a PC board assembly 80. More particularly, in the particular embodiment of FIG. 4, two sockets 10 are assembled with a bracket 46 and two processors 44, each powered by a power pod 68. Two heat sinks 70 are mounted to heat spreaders 72 that, in turn, are each affixed to a processor 44. The power pods 68 of this embodiment comprise dc—dc converters that may be electrically coupled to the processors 44 by any means known to the art, such as by a ribbon cable (not shown), and mounted to bracket 46 in any suitable manner known to the art. Processors 44 may be microprocessors or digital signal processors, but other types of processors may be employed for one, or both, of the processors 44 shown in FIG. 4.

The ZIF socket 10 therefore fulfills several needs in the art. For instance, because processors 44 can be mounted on both sides of board 42, more processors 44 can be mounted per board. Further, because of the low profile, lateral lever 26, less space is needed between board assemblies 80. Both factors help increase component density. The particular embodiments disclosed also provide convenient mechanisms facilitating assembly of components into printed circuit board assemblies. Further, the surface mounting of the ZIF socket 10 permits mounting processors 44 on both sides of the PC board 42, thereby shortening bus lengths. Still further, the use of mounting bracket 46 reduces the stress and strain associated with mounting the processors 44.

The particular embodiments disclosed above are illustrative only as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A printed circuit board assembly comprising:

a printed circuit board;

a zero insertion force socket surface mounted to the printed circuit board to couple an integrated circuit device; and a bracket affixed to the printed circuit board, the bracket to constrain vertical and lateral movement of the zero insertion force socket and/or the integrated circuit device.

2. The assembly of claim 1, wherein the zero insertion force socket comprises:

a base;

a cover engaged with the base; and a lever pivotably mounted to reciprocate one of the cover and the base relative to the other one of the cover and the base when the lever is pivoted.

3. The assembly of claim 1, wherein the zero insertion force socket comprises:

a base having first and second sides, at least one of the first and second sides having a plurality of solder bumps and two blind bores;

a cover engaged with the base; and a lever pivotably mounted to reciprocate one of the cover and the base relative to the other one of the cover and the base; and wherein the printed circuit board has two pins extending therefrom to engage the blind bores.

4. The assembly of claim 1, comprising a power pod to couple to the integrated circuit device electrically.

5. The assembly of claim 1, comprising a heat spreader to affix to the integrated circuit device and a heat sink affixed to the heat spreader.

6. A printed circuit board assembly comprising:

a printed circuit board having two pins extending vertically therefrom;

a zero insertion force socket surface mounted to the printed circuit board, the socket comprising:

a socket base having first and second sides, at least one of the first and second sides including a plurality of solder bumps and two blind bores, the blind bores being engaged with the pins;

a cover engaged with the socket base; and a lever pivotably mounted to reciprocate one of the cover and the socket base relative to the other one of the cover and the socket base in first and second directions when the lever is pivoted laterally from a first position to a second position, the lever comprising:

a cam by which the lever is pivotably mounted; and a shaft for rotating the cam, the shaft extending laterally from the zero insertion force socket;

a processor coupled to the zero insertion force socket; and a bracket affixed to the printed circuit board, the bracket vertically and laterally constraining movement of the socket and the processor, the bracket comprising:

a bracket base having an opening shaped to accommodate the socket; and at least one containment member rigidly extending from the bracket base to define a void shaped to accommodate the processor.

7. A method comprising:

surface mounting a zero insertion force socket to a printed circuit board, the zero insertion force socket having a plurality of pin holes and a lever, wherein the zero insertion force socket has a bottom and wherein the surface mounting comprises:

providing a pin extending from the printed circuit board, providing a bore in the zero insertion force socket, providing a plurality of solder bumps on the bottom of the zero insertion force socket, aligning the pin with the bore, and engaging the pin with the bore;

inserting a plurality of contact pins from an integrated circuit device into pin holes of the zero insertion force socket; and throwing the lever of the zero insertion force socket to establish an electrical coupling.

8. The method of claim 7, wherein the throwing comprises pivoting the lever of the zero insertion force socket laterally.

9. The method of claim 7, wherein the zero insertion force socket comprises:

a base;

a cover engaged with the base; and the lever is pivotably mounted to move one of the cover and the base relative to the other one of the cover and the base when the lever is pivoted laterally.

10. The assembly of claim 2, wherein the lever comprises:

a cam by which the lever is pivotably mounted, and a shaft for rotating the cam, the shaft extending laterally from the zero insertion force socket.

11. The assembly of claim 2, wherein the cam and the shaft are integrally formed.

12. The assembly of claim 2, wherein the cover is biased in one direction.

13. The assembly of claim 1, wherein the bracket comprises:

a bracket base having an opening shaped to accommodate the zero insertion force socket, and at least one containment member rigidly extending from the bracket base to define a void shaped to accommodate the integrated circuit device.

14. The assembly of claim 8, comprising the integrated circuit device coupled to the zero insertion force socket, wherein the integrated circuit device is a processor.

15. A printed circuit board assembly comprising:

a printed circuit board having two pins extending therefrom;

a zero insertion force socket surface mounted to the printed circuit board to couple an integrated circuit device, wherein the zero insertion force socket comprises:

a base having first and second sides, at least one of the first and second sides having a plurality of solder bumps and two blind bores engaged with the pins, a cover engaged with the base, and a lever pivotably mounted to reciprocate one of the cover and the base relative to the other one of the cover and the base.

16. The assembly of claim 15, wherein the lever is mounted to pivot laterally.

17. The assembly of claim 15, comprising a power pod to couple to the integrated circuit device electrically.

18. The assembly of claim 15, comprising a heat spreader to affix to the integrated circuit device and a heat sink affixed to the heat spreader.

19. The assembly of claim 15, wherein the lever comprises:

a cam by which the lever is pivotably mounted, and a shaft for rotating the cam, the shaft extending laterally from the zero insertion force socket.

20. The assembly of claim 19, wherein the cam and the shaft are integrally formed.

21. The assembly of claim 15, wherein the cover is biased in one direction.

22. The assembly of claim 15, comprising the integrated circuit device coupled to the zero insertion force socket, wherein the integrated circuit device is a processor.

23. The method of claim 7, comprising:

affixing a bracket to the printed circuit board to constrain vertical and lateral movement of the zero insertion force socket and/or the integrated circuit device.

24. The method of claim 23, wherein the bracket comprises:

a bracket base having an opening shaped to accommodate the zero insertion force socket, and at least one containment member rigidly extending from the bracket base to define a void shaped to accommodate the integrated circuit device.

25. A method comprising:

affixing a bracket to a printed circuit board;

mounting a zero insertion force socket to the printed circuit board, the zero insertion force socket having a plurality of pin holes and a lever;

inserting a plurality of contact pins from an integrated circuit device into pin holes of the zero insertion force socket, the bracket constraining vertical and lateral movement of the zero insertion force socket and/or the integrated circuit device; and throwing the lever of the zero insertion force socket to establish an electrical coupling.

26. The method of claim 25, wherein the bracket comprises:

a bracket base having an opening shaped to accommodate the zero insertion force socket, and at least one containment member rigidly extending from the bracket base to define a void shaped to accommodate the integrated circuit device.

27. The method of claim 25, wherein the throwing comprises pivoting the lever of the zero insertion force socket laterally.

28. The method of claim 25, wherein the zero insertion force socket comprises:

a base;

a cover engaged with the base; and the lever is pivotably mounted to move one of the cover and the base relative to the other one of the cover and the base when the lever is pivoted laterally.

29. The assembly of claim 2, wherein the lever is mounted to pivot laterally.

* * * * *